US005094297A

United States Patent [19]

Bridges

[11] Patent Number: 5,094,297

[45] Date of Patent: Mar. 10, 1992

[54] CASING WEIGHT SET SEAL RING

[75] Inventor: Charles D. Bridges, Houston, Tex.

[73] Assignee: ABB Vetco Gray Inc., Houston, Tex.

[21] Appl. No.: 605,733

[22] Filed: Oct. 30, 1990

[51] Int. Cl.[5] ..... E21B 33/03

[52] U.S. Cl. ..... 166/382; 166/208; 277/116.2; 277/117

[58] Field of Search ..... 166/382, 208, 209, 217; 277/116.2, 116.8, 117, 144, 236

[56] References Cited

U.S. PATENT DOCUMENTS 4,749,047 6/1988 Taylor ..... 166/382
4,781,387 11/1988 Braugh ..... 277/12
4,791,987 12/1988 Cassity et al. ..... 166/85
4,832,125 5/1989 Taylor ..... 166/348

*Primary Examiner*—William P. Neuder
*Attorney, Agent, or Firm*—James E. Bradley

[57] ABSTRACT

An apparatus and method for supporting and sealing a string of casing in a well utilizes the weight of the casing to form the seal. A tubular housing locates at the surface of the well. A seal sleeve is placed on a landing shoulder in the bore of the housing. A suspension mandrel connects to the upper end of the string of casing. The mandrel has an external tapered surface that engages an internal tapered surface and a seal sleeve. This creates a wedging action which moves the seal sleeve radially outward to seal against the bore of the housing. The weight of the string of casing pulls the mandrel down in the seal sleeve to cause this wedging action.

8 Claims, 2 Drawing Sheets

CASING WEIGHT SET SEAL RING

BACKGROUND OF THE INVENTION

1. Field of the invention

This invention relates in general to metal seals for sealing between a casing and a wellhead housing, and in particular to a seal that utilizes the weight of the casing to deflect the seal.

2. Description of the Prior Art

In oil and gas wells, casing will be set in the well. A tubular wellhead housing locates at the surface. A casing seal seals the annular space between the upper end of the casing and the wellhead housing. Slips or casing hangers suspend the casing in the wellhead housing.

There are many types of seals and suspension assemblies. Many systems employ elastomeric seals. In the past few years, metal-to-metal seals have become feasible. These types of seals will not deteriorate under long term usage.

Generally, a special seat must be machined in the housing to receive a metal seal. Machining a seat within a housing is complex. Also, a machined seat in a housing may be damaged, making repair difficult. Also, a metal seal normally requires a running tool to deflect the seal into tight sealing engagement. Running tools are normally hydraulically actuated and expensive.

SUMMARY OF THE INVENTION

The apparatus of this invention utilizes a seal sleeve for landing on the wellhead housing landing shoulder. The seal sleeve has a bore with an internal landing shoulder. A tubular suspension mandrel connects to the upper end of the casing. The mandrel has an exterior landing shoulder which lands on the seal sleeve.

The mandrel has an exterior tapered wedging surface which engages an interior tapered wedging surface located in the seal sleeve. As the mandrel lands in the seal sleeve, it wedges the seal sleeve outward. The seal sleeve has exterior metal sealing surfaces which engage the bore when the seal sleeve deflects outward.

DETAILED DESCRIPTION OF THE INVENTION

Figure 1:
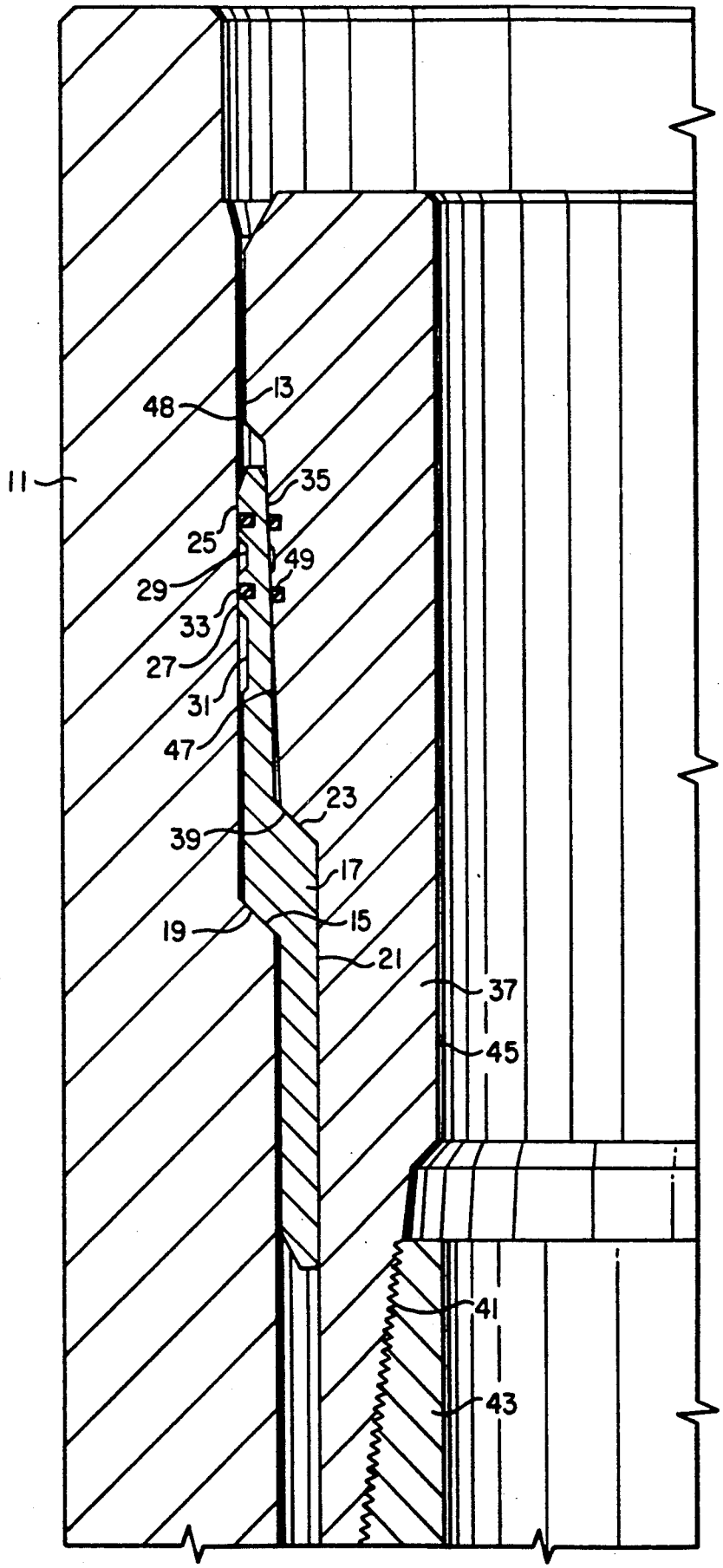
FIG. 1 is a vertical partial sectional view illustrating an apparatus constructed in accordance with this invention, and showing a suspension mandrel and seal sleeve in a set position.
Figure 2:
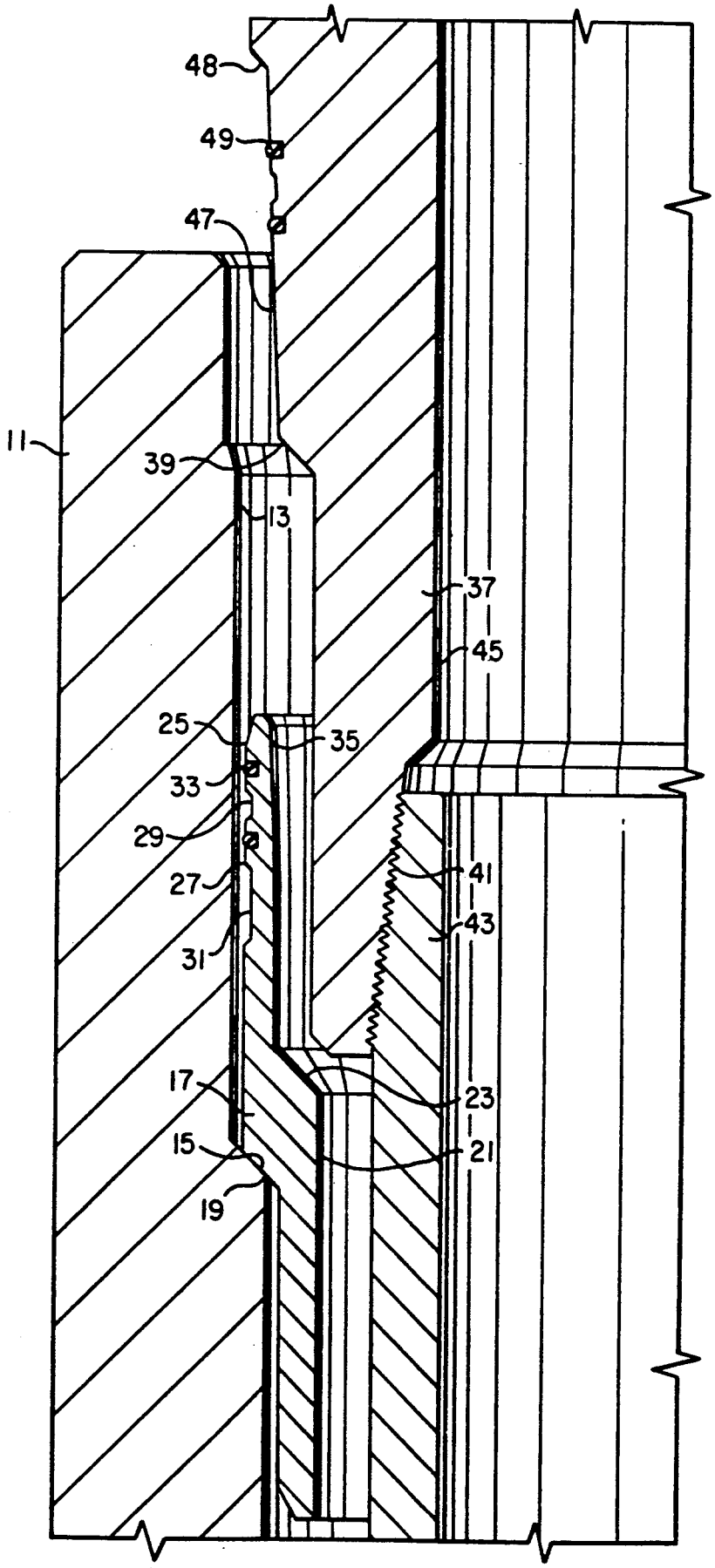
FIG. 2 is a partial vertical sectional view of the apparatus of FIG. 1, and shown prior to setting.

The wellhead system of this invention includes a tubular wellhead housing 11. Housing 11 will locate at the surface of the well. Housing 11 has an axial cylindrical bore 13. Bore 13 has an upward facing landing shoulder 15. Landing shoulder 15 is conical, preferably at a 45 degree angle relative to the longitudinal axis of the housing 11.

A seal sleeve 17 will locate within the bore 13. Seal sleeve 17 is a tubular member of metal, preferably steel. It has an external landing shoulder 19 located about halfway along its length. Landing shoulder 19 faces downward and outward, also at a 45 degree angle, for landing on the bore landing shoulder 15. A portion of seal sleeve 17 will extend below the landing shoulder 15. Sleeve 17 has an axial bore 21 extending through it.

Bore 21 has an internal landing shoulder 23 which faces upward and outward, preferably at a 45 degree angle.

Seal sleeve 17 has a pair of sealing surfaces 25, 27 on its exterior. The sealing surfaces 25, 27 are located near the upper end of seal sleeve 17. Each sealing surface 25, 27 is an annular, cylindrical band. A recess 29 axially separates the sealing surfaces 25, 27 from each other. Another annular recess 31 locates directly below the lower sealing surface 27.

The sealing surfaces 25, 27 protrude outward from the recesses 29, 31. An elastomeric seal ring 33 locates in a groove adjacent each sealing surface 25, 27. The elastomeric seal rings 33 locate between the sealing surfaces 24, 27 and are redundant for the metal sealing surfaces 25, 27. The outer diameters of sealing surfaces 25, 27 are identical and initially slightly less than the inner diameter of bore 13.

The bore 21 of the seal sleeve 17 has a tapered section 35. Tapered section 35 begins at the upper end of seal sleeve 17 and extends downward to a point that is opposite the lower edge of the lower sealing surface 27. The tapered section 35 is frusto-conical, having a larger diameter at its upper end than at its lower extent. The degree of taper is fairly small, being only a few degrees relative to the longitudinal axis of seal sleeve 17. The portion of sleeve bore 21 directly below the tapered section 35 is cylindrical down to the sleeve internal landing shoulder 23. Tapered section 35 is a metal sealing surface.

The wall thickness of the tapered section 35 and the material of the seal sleeve 17 are selected so that when set, the tapered section 35 of seal sleeve 17 will deflect radially outward until the sealing surfaces 25, 27 tightly engage the bore 13. This amount of deflection, however, is not so high so as to cause permanent deformation of the seal sleeve 17. It is within the elastic range of the seal sleeve 17. For example, the seal sleeve 17 may be formed of steel having a 75,000 pounds per square inch yield strength. The deflection may be roughly 0.050 inch increase in diameter for a 20 inch inner diameter housing 11.

A suspension mandrel 37 lands within the seal sleeve 17. Suspension mandrel 37 is a tubular member, having an external landing shoulder 39. Landing shoulder 39 faces downward at a 45 degree angle for landing on the sleeve internal landing shoulder 23. Internal threads 41 located at the lower end of suspension mandrel 37 serve as means for connecting the suspension mandrel 37 to a string of casing 43. Mandrel 37 has an axial bore extending through it that is cylindrical.

Mandrel 37 has a tapered section 47 on its exterior. The tapered section 47 extends from the mandrel landing shoulder 39 upward to a cylindrical rim 48. The degree of taper of the mandrel tapered section 47 is the same as the degree of taper of the sleeve tapered section 35. The axial length of the mandrel tapered section 47 is greater than the length of the sleeve tapered section 35. The outer diameter of the mandrel tapered section 47 at its upper extent near the rim 48 is greater than the initial inner diameter of the sleeve tapered section 35 at its upper extent. The lower extent of the mandrel tapered section 47 has a lesser outer diameter than the inner diameter of the upper end of the seal tapered section 35.

The mandrel tapered section section 47 will form a metal-to-metal seal with the sleeve tapered section. Also, the conical surface of the mandrel tapered section 47 creates a radially outward wedging action on the sleeve tapered section 35. The wall thickness of the sleeve tapered section 35, the weight of casing 43, and the type of metal of seal sleeve 17 are selected so that the mandrel 37 will deflect the seal sleeve sealing surfaces 25, 27 into tight sealing engagement with the housing bore 13.

Mandrel 37 has a pair of elastomeric seal rings 49 located within grooves in the mandrel tapered section 47. The seal rings 49 are redundant for the metal-to-metal sealing engagement of the mandrel tapered section 47 with the sleeve tapered section 35.

In operation, the seal sleeve 17 will be placed in housing bore 13 on the bore landing shoulder 15. The casing 43 will be lowered into the well, section by section. When the lower end of casing 43 is close to the bottom of the well, the suspension mandrel 37 will be secured to the string of casing 43. Then, the suspension mandrel 37 will be lowered into the seal sleeve 17. Optionally, the seal sleeve 17 could be attached to the mandrel 37 before the mandrel 37 is lowered into the housing 11.

As the suspension mandrel 37 moves downward in the seal sleeve 17, the mandrel tapered section 47 will slidingly engage the sleeve tapered section 35. The wedging action will cause the seal sleeve 17 to deflect radially outward at these sealing surfaces 25, 27. The sealing surfaces 25, 27 will contact the housing bore 13 and form a sealing engagement. The mandrel 37 will then land on the seal sleeve landing shoulder 23. The weight of the string of casing 43 is sufficient to pull the suspension mandrel 37 downward until it lands on the landing shoulder 23. The upper extent of the mandrel tapered section 47 will be a short distance above the upper extent of seal sleeve tapered section 35 when the mandrel 37 has landed on the internal shoulder 23.

Once landed, the suspension mandrel 37 will support the weight of the string of casing 43. The load will transmit through the seal sleeve shoulder 23 to the housing bore shoulder 15. Cementing can take place either before landing or after landing and washout. Cement returns can be handled by annular outlets (not shown) below the seal sleeve 17 if the cementing is performed after the seal sleeve 17 is set.

The invention has significant advantages. It allows a metal seal to be formed in a wellhead housing without the need for special machining in the housing. The tolerances may greater than with prior art metal seals. There is no requirement for any special running tools. The weight of the string of casing suspended below the mandrel causes the wedging action to occur. The seal sleeve is only elastically deformed, thus can be used for subsequent installations if the casing is pulled.

While the invention has been shown in only one of its forms, it should be apparent to those skilled in the art that it is not so limited, but is susceptible to various changes without departing from the scope of the invention.

I claim:

1. In an apparatus for supporting and sealing a string of casing in a well of a type having at the upper end of the well a tubular housing with a bore and a housing landing shoulder therein, the improvement comprising in combination:

a metal seal sleeve having a downward facing external shoulder adapted to be landed on the housing landing shoulder, the seal sleeve having an external sealing surface and a bore with an internal sealing surface and an upward facing internal shoulder;

a tubular suspension mandrel having an external wedging section which slidingly engages the internal sealing surface of the bore of the sleeve, the suspension mandrel moving downward into the seal sleeve when the seal sleeve lands on the landing shoulder in the housing and having an external downward facing shoulder which lands on the internal shoulder of the seal sleeve;

means on a lower end of the suspension mandrel for securing the suspension mandrel to the string of casing; and the wall thickness of the sleeve being dimensioned such that the weight of the string of casing will cause the suspension mandrel to wedge the sealing surface of the seal sleeve radially outward into sealing engagement with the bore of the housing as the suspension mandrel lands in the seal sleeve, with the wedging section of the mandrel sealing against the internal sealing surface of the seal sleeve.

2. An apparatus for supporting and sealing a string of casing in a well, comprising in combination:

a tubular housing for location at the upper end of the well, the housing having a bore and a housing landing shoulder therein;

a metal seal sleeve landed on and in engagement with the housing landing shoulder, the seal sleeve having a bore and a sleeve tapered section, the seal sleeve having an external sealing surface opposite the sleeve tapered section;

a tubular suspension mandrel having a lower end, the suspension mandrel having an external tapered section which slidingly mates with the sleeve tapered section, the suspension mandrel being capable of downward movement relative to the seal sleeve as the mandrel is inserted into the seal sleeve; and threads on a lower end of the mandrel for connecting the lower end of the suspension mandrel to the string of casing, the suspension mandrel forcing the sealing surface of the seal sleeve radially outward into sealing engagement with the bore of the housing during downward movement of the suspension mandrel as it lands in the seal sleeve.

3. In an apparatus for supporting and sealing a string of casing in a well of a type having a tubular housing, the housing having a bore and a housing landing shoulder therein, the improvement comprising in combination:

a metal seal sleeve adapted to land on the housing landing shoulder, the seal sleeve having a bore and a sleeve external landing shoulder which lands on the housing landing shoulder, the bore of the seal sleeve having a sleeve internal landing shoulder and a sleeve tapered section located above the sleeve internal landing shoulder, the seal sleeve having an external sealing surface opposite the sleeve tapered section and an internal sealing surface on the sleeve tapered section;

a tubular suspension mandrel having a threaded lower end adapted to be secured to the string of casing, the suspension mandrel having an external mandrel landing shoulder which lands on the seal sleeve internal landing shoulder when the seal sleeve has landed on the housing landing shoulder, the suspension mandrel having an external tapered section which mates and seals with the sleeve tapered section; and the wall thickness of the sleeve tapered section being dimensioned such that the weight of the string of casing will cause the suspension mandrel to force the sealing surface of the seal sleeve radially outward into sealing engagement with the bore of the housing as the suspension mandrel moves downward relative to the seal sleeve.

4. In an apparatus for supporting and sealing a string of casing in a well of a type having a tubular housing adapted to be mounted at the upper end of the well, the housing having a bore and a conical housing landing shoulder therein, the improvement comprising in combination:

a metal seal sleeve having an external conical landing surface which lands on the housing landing shoulder, the seal sleeve having a bore and an internal conical sleeve landing shoulder formed therein, the bore of the seal sleeve having a sleeve tapered section located above the sleeve landing shoulder which is conical with a larger diameter at its upper extent than at its lower extent, the seal sleeve having an external sealing surface opposite the sleeve tapered section which is cylindrical and having an internal sealing surface at the sleeve tapered section;

a tubular suspension mandrel, the suspension mandrel having an external conical mandrel landing shoulder which lands on the seal sleeve landing shoulder, the suspension mandrel having an external tapered section located above the mandrel landing shoulder which has the same taper as and mates and seals with the sleeve tapered section;

means including threads on a lower end of the suspension mandrel for securing the suspension mandrel to the string of casing to support the string of casing in the housing;

the outer diameter of the sealing surface of the seal sleeve initially being less than the diameter of the bore of the housing opposite the sealing surface, defining an annular clearance; and the wall thickness of the seal sleeve being dimensioned such that the weight of the string of casing will cause the suspension mandrel to deflect the seal sleeve radially outward as the suspension mandrel moves downward in the seal sleeve, closing the annular clearance and forcing the sealing surface of the seal sleeve into sealing engagement with the bore of the housing.

5. In an apparatus for supporting and sealing a string of casing in a well of a type having a tubular housing adapted to be mounted at the upper end of the well, a cylindrical bore and a conical housing landing shoulder therein, the improvement comprising in combination:

a metal seal sleeve having an external conical landing surface adapted to land on the housing landing shoulder, the seal sleeve having a bore and an internal conical sleeve landing shoulder formed therein, the bore of the seal sleeve having a sleeve tapered section located above the sleeve landing shoulder which is conical with a larger diameter at its upper extent than at its lower extent, the seal sleeve having a tubular lower portion which extends downward from the external conical landing surface;

at least one metal external sealing surface located on the exterior of the sealing sleeve opposite the sleeve tapered section, the external sealing surface being a cylindrical band protruding radially outward from the exterior of the seal sleeve;

a tubular suspension mandrel having an external conical mandrel landing shoulder which lands on the seal sleeve landing shoulder, the suspension mandrel having an external tapered section located above the mandrel landing shoulder which is conical and has the same degree of taper as the sleeve tapered section for slidingly engaging the sleeve tapered section; and means on a lower end of the suspension mandrel for securing the suspension mandrel to the string of casing to support the string of casing in the housing, the suspension mandrel slidingly engaging the sleeve tapered section and forcing the sealing surface of the seal sleeve radially outward into sealing engagement with the bore of the housing as the mandrel lands in the seal sleeve, with the external tapered section of the mandrel forming a metal-to-metal seal with the sleeve tapered section.

6. The apparatus according to claim 5 further comprising an elastomeric seal located adjacent the cylindrical band.

7. The apparatus according to claim 5 wherein:

the material of the sleeve and the amount of radial outward deflection are selected such that the deflection of the seal sleeve is elastic deformation, allowing the seal sleeve to return to its original dimensions for reuse when the suspension mandrel is pulled upward from the seal sleeve.

8. A method for supporting and sealing a string of casing in a well, comprising in combination:

positioning a tubular housing at the surface of the well, and providing the housing with a bore and a housing landing shoulder formed therein;

providing a metal seal sleeve with an external sealing surface and an internal sealing surface;

placing the seal sleeve on the housing landing shoulder;

providing a tubular suspension mandrel with an external wedging section;

securing the suspension mandrel to the string of casing;

lowering the casing into the well and the suspension mandrel into the seal sleeve, the weight of the casing causing the wedging section of the suspension mandrel to force the sealing surface of the seal sleeve radially outward into sealing engagement with the bore of the housing; and landing the suspension mandrel in the seal sleeve to transmit the load from the weight of the casing through the seal sleeve to the housing landing shoulder, and causing the external wedging section of the mandrel to seal against the internal sealing surface of the seal sleeve.

* * * * *